United States Patent [19]

Knieser

[11] 4,089,683

[45] May 16, 1978

[54] LIQUID DEVELOPER CLEANING MEANS

[75] Inventor: James J. Knieser, Webster, N.Y.

[73] Assignee: Xerox Corporation, Stamford, Conn.

[21] Appl. No.: 626,954

[22] Filed: Oct. 29, 1975

[51] Int. Cl.[2] ..... G03G 21/00

[52] U.S. Cl. ..... 96/1 LY; 15/1.5 R; 118/DIG. 23; 355/10; 355/15; 427/15

[58] Field of Search ..... 355/15–17, 355/10; 15/1.5–256.53; 118/104, 106, 70, DIG. 23; 134/6; 427/15–16; 96/1 LY, 1.4

[56] References Cited

U.S. PATENT DOCUMENTS

| | | | |
|---|---|---|---|
| 3,776,632 | 12/1973 | Smith et al. | 355/15 |
| 3,781,107 | 12/1973 | Ruhland | 355/15 |
| 3,879,785 | 4/1975 | Roth et al. | 355/15 |
| 3,918,809 | 11/1975 | Hwa | 355/10 |

*Primary Examiner*—Stephen J. Tomsky
*Attorney, Agent, or Firm*—James J. Ralabate; Ernest F. Chapman

[57] ABSTRACT

An improved apparatus and method for the conditioning of reusable imaging surfaces after the liquid development thereon of a charge pattern and the transfer therefrom of the developed image to eliminate subsequent transfer of residual liquid developer from the imaging surface cleaned by conventional methods, is described. The imaging surface is prepared for a subsequent cycle by bringing the imaging surface into moving contact with the advancing, transversely-oriented foam belt having a pattern of raised and depressed areas redistributing streaks and deposits of liquid developer remaining on an imaging surface after bringing the imaging surface into moving contact with conventional cleaning means.

19 Claims, 6 Drawing Figures

LIQUID DEVELOPER CLEANING MEANS

BACKGROUND OF THE INVENTION

This invention relates generally to electrostatography and more particularly to improvements in electrostatographic copying employing liquid development techniques.

Processes for forming latent electrostatic images, existing as electrostatic charge patterns upon a substrate, and for subsequently converting the latent electrostatic image into a visual pattern, are well known. Generally, such electrostatic techniques have been carried out by using toners which are dry powders. However, many techniques have been developed in which the toner particles are incorporated in a liquid carrier, and in electrostatic printing wherein latent electrostatic images are formed on a photoconductive surface of a recording element by uniformly charging the surface thereof, as by a corona discharge device, followed by exposure to light in the desired image pattern, such images may also be developed by liquid developers. In these electrostatographic copying processes a charge pattern is established on an imaging surface and is developed by a liquid development process wherein the liquid developer is presented to the charge pattern by suitable applicator means. In one type of liquid development, the suspended toner particles are electrostatically charged and develop the latent image by migration of the particles to the image surface under influence of the image charge. This is known as electrophoretic development and utilizes the developers having insulating liquids of relatively high volume resistivity. In another type of liquid development, the entire liquid developer is attracted to the imaging surface in image configuration by the electrostatic forces of the charge pattern. Liquid developers for these techniques are well known in the art.

One of the preferred types of electrostatic image development is disclosed by Gundlach in U.S. Pat. No. 3,084,043 and U.S. Pat. No. 3,551,146, where liquid developers having relatively low viscosity, low volatility, contrast in color in the usual case to the surface on which it will remain, and relatively high electrical conductivity (relatively low volume resistivity), are disclosed for converting the electrostatic latent image to a visible image. According to this method, liquid developer from a reservoir is deposited on a gravure roller and fills the depressions in the roller surface. Excess developer is removed from the lands between depressions, and as a receiving surface charged in image configuration passes against the gravure roller, the liquid developer is attracted from the depressions in image configuration by the charge. This method of development is referred to as polar liquid development. This type of liquid development process is also described by Amidon et al in U.S Pat. No. 3,806,354 where high volume resistivity liquid developers are used. In certain embodiments the development occurs on an interposition surface or web which has been imaged while in intimate contact with the photoconductor surface. Liquid developer in image configuration to the interposition surface is then transferred to another substrate. As used herein, "imaging surface" also encompasses interposition surfaces or webs, and both types of surfaces are deemed to be "surfaces to be cleaned".

In the development of electrostatic latent images where liquid developers are used to develop the image on the resuable photoconductor surface or on the reusable interposition surface, liquid developer remains on the surface after the developer image is transferred to a substrate. In these processes and apparatuses where the surface is reused to develop subsequent images, the residual liquid developer must be removed therefrom to such an extent that the residual developer will not interfere with subsequent imaging causing streaks and other image or non-image patterns and smudges of developer which transfer to subsequent substrates. When the developer remains on the surface to be cleaned in levels above transfer thresholds, then transfer of the developer will occur at the transfer station. In order to accomplish sufficient removal of the residual developer so that the streaking and smudging of subsequent prints is eliminated, several prior art methods have been attempted, but they have generally been unsatisfactory.

Cleaning means which are more specifically intended for use in the liquid development processes are shown in copending U.S. patent applications, U.S. Ser. No. 482,716 filed June 24, 1974, now U.S. Pat. No. 3,940,282, issued to S. C. P. Hwa; U.S. Ser. No. 409,994 filed Oct. 26, 1973, now abandoned; and U.S. Ser. No. 482,726 filed June 24, 1974, now U.S. Pat. No. 3,918,809, issued to S. C. P. Hwa.

The cleaning means of the prior art include brushes, wiper blades, scraper blades, rotating absorbent members rotating parallel with the surface being cleaned, and sets of blades working together. Scraper blades, also frequently referred to as "leading edge blades", have in the past been found to be the most satisfactory cleaning means for use in the cyclic liquid development of charge patterns. This type of member is deemed to be one of the prior art "conventional cleaning means".

Wiper blades are also commonly used to remove residual quantities of liquid developers, but cleaning systems comprised of wiper blades leave streaks of developer on the surface, especially when dust, lint, paper fibers and the like collect between the wiper blade and the surface. Thus, when wiper blades are used, frequent cleaning of the blade itself is required to remove the debris collecting on the blade. Debris, defined herein as lint, dust, paper fibers and other undesirable solid particles which collect in copying machines, interferes with the intimate contact between the blade and the surface. Furthermore, when the wiper blade is used in contact with the surface sufficiently intimate to remove the residual developer, there is either excessive wear of the surface especially if the surface is rigid, or there is frequent damage to flexible surfaces, such as, film-like materials.

Dual systems for the removal of liquid developer from copy sheets have been described in the prior art wherein a doctoring apparatus (wiper blades) is used to remove excess liquid from the developed image surface of the copy sheet prior to squeegeeing of the sheet. However, such a system does not remove layers of toner deposited in image configuration on the copy sheet, and accordingly, it is incapable of removing residual streaks and smudges and other image and non-image patterns for such surfaces as photoconductor and interposition surfaces.

Other dual cleaning systems disclosed in the prior art encompass wiper blade assemblies following sponge-like members, but in such systems the sponge-like members are used to apply cleaning solvents, and the wiper blade removes the solvent or prevents solvent from passing to other parts of the apparatus. In view of the limitations on the use of cleaning solvents in electrostatic printing machines due to environmental concerns and health hazards, such techniques are limited in application. Furthermore, in any dual cleaning system for electrostatic copying systems using liquid developers wherein the second cleaning element is a wiper blade, eventual accumulation of debris on the wiper blade will interfere with the ability of the blade to maintain intimate contact with the surface with the result that streaks and smudges of developer will remain on the surface in spite of the fact that the surface is in contact with the blade. Other systems comprising wet cleaning webs have been proposed but these systems utilize solvents to loosen and remove residual toner. Such systems are undesirable because they require solvent applicator systems and generally employ solvents of a hazardous nature which effect environmental purity. Rotating brush systems have also been suggested but brushes contribute to the debris accumulation.

Imaging member cleaning means also suitable for use in the cyclic development of charge patterns include those shown and described in U.S. Pat. No. 3,522,850; U.S. Pat. No. 3,781,107; U.S. Pat. No. 3,859,691; and U.S. Pat. No. 3,664,300. Such cleaning means, however, are most suitable for use in "dry xerography" as taught for example, in U.S. Pat. No. 2,297,691 wherein the charge patterns are developed by a finely divided material referred to in the art as "toner". In U.S. Pat. No. 3,781,107 there is shown an endless loop cleaner in the form of a web or belt composed of a material suitable for removal of marking material from an imaging surface, the web or belt being transported over an area of sweeping engagement with the imaging surface in a direction transverse to the longitudinal dimension of the imaging surface. The powdered marking material removed from the imaging surface is thereafter removed from the web or belt. However, this system is deficient for cleaning liquid developer from the imaging surface because of the absence of a primary cleaning member. Furthermore, because of the belt configuration there would be substantial drag from the working surface contacting the imaging surface, especially when a backing member is used to maintain contact between the imaging surface and the belt surface. Furthermore, the exposed web or belt material tends to absorb liquid developer when it is made of a porous material, and upon reaching a certain level of saturation, this type of member reapplies transferable amounts of absorbed liquid developer to the surface being cleaned.

While ordinarily capable of producing good quality images, conventional liquid developing systems suffer serious deficiencies in certain areas. The above enumerated prior art cleaning devices when used in connection with certain oil based liquid developers typified by those described in the prior art, often fail to prevent the formation of streaks or deposits of liquid developer on the imaging surface. These streaks and/or deposits transfer to the final copy even when multiple blades are used. The deposits or streaks of liquid developer are observed to appear on the imaging surface after as few as 400 cycles or less in some systems although other systems may not develop deposits or streaks until after 8,000 cycles. Once formed, the deposits and/or streaks build up sufficiently to cause unacceptable print out of the streak or deposit in the final copy after a comparatively small number of additional cycles.

OBJECTS OF THE INVENTION

Accordingly, it is an object of this invention to provide a method and apparatus for improving cyclical reconditioning of reusable surfaces used in electrostatic copying machines employing liquid developers for development of the image.

Another object of this invention is to provide an improved apparatus and method for the removal of liquid developer streaks and/or deposits upon an imaging or interposition surface engaged by conventional cleaning means.

It is another object of this invention to provide an improved reusable imaging surface cleaning means for use in the liquid development of charge patterns on an imaging surface which prevents the occurrence of undesirable deposits and/or streaks of liquid developer on the imaging surface and corresponding print-outs in the final copy.

Still another object of this invention is to provide a method and apparatus for cleaning reusable imaging surfaces wherein the cleaning means substantially reduces wear and abrasion of the surface being cleaned.

Another object of this invention is to provide an improved movable cleaning means which produces reduced levels of drag or friction with the surface to be cleaned.

Additional objects of this invention will become apparent to those versed in the art of electrostatic copying machines in view of the following detailed description of the method and apparatus taken in conjunction with the accompanying drawings, in which preferred embodiments of the apparatus as shown.

SUMMARY OF THE INVENTION

Briefly, these and other objects are accomplished by providing a movable, compressible, resilient belt having a pattern of raised and depressed portions which redistribute residual liquid developer on the imaging surface to thicknesses below transfer levels. This thickness below transfer level may be defined as a thin, non-transformable film. There is provided a method for improved conditioning of imaging surfaces or interposition surfaces after the liquid development thereon of a charge pattern and the transfer therefrom of the developed image, said method comprising (a) bringing the imaging surface into moving contact with a cleaning means followed by (b) bringing the imaging surface into moving contact with a moving, compressible, resilient belt having a pattern of raised and depressed portions on the working surface for redistributing irregular deposits of residual liquid developer remaining on the imaging surface to other areas of the imaging surface. Thus, heavier deposits of residual liquid developer, including streaks of liquid developer, are distributed to those areas of the imaging surface having little or no liquid developer deposited thereon. The working surface of the belt must be made of a substantially non-absorbent material.

According to another aspect of the invention, there is provided an apparatus for the improved conditioning of imaging surfaces or interposition surfaces after the liquid development thereon of a charge pattern and the transfer therefrom of the developed image comprising (a) cleaning means which is brought into moving contact with the imaging surface and (b) a movable, compressible, resilient belt having a pattern of raised and depressed areas on the subtantially non-absorbent working surface for redistributing irregular, residual deposits of liquid developer remaining on the imaging surface, to other areas of the imaging surface. The movable redistribution means is located at a point downstream (in the direction of the advancing imaging or interposition surface) from the cleaning means. By movable or advancing belt is meant one which is capable of moving relative to the surface which it engages, e.g., an imaging surface. Substantially non-absorbent working surface as used herein, is a surface comprising a material which does not readily absorb the liquid developer being redistributed to the point where the material reapplies the absorbed liquid developer to the surface being cleaned.

When applied continually to a cyclic imaging surface, the improved surface conditioning means of this invention is at least substantially effective to prevent print out of liquid developer streaks, smudges or other deposits on the final copy caused by insufficient cleaning of the surface to be cleaned by the cleaning means. In operation, the improved conditioning means and process of the present invention may be used intermittently with a cycling imaging surface to remove the undesirable deposits and/or streaks when transfer and print-out thereof begins to occur in the final copy, or the improved imaging surface conditioning means may be applied continually against a cycling imaging surface.

As used herein, imaging surface, surface to be cleaned and interposition surface are used interchangeably.

Means are also provided in the surface conditioning system for moving the surface to be cleaned and moving the redistribution means in a transverse direction relative to the direction of movement of the surface to be cleaned. By moving in a transverse direction is meant a sweeping motion substantially in the longitudinal direction of the axis of the drum or substantially in a direction perpendicular to the motion of the surface to be cleaned. "Substantially" in this context provides not only for an orientation of the belt which is parallel to the axis or perpendicular to the direction of motion of the surface being cleaned, but also for the orientation of the belt at a skewed angle across the surface being cleaned.

It has been discovered that the compressible, resilient belt or web which engages the imaging surface, has a substantially reduced level of drag or friction when there is a pattern of raised and depressed areas on the working surface of the belt, and that this pattern promotes the re-distribution of the liquid developer residues to non-transferrable levels.

DESCRIPTION OF THE PREFERRED EMBODIMENTS

Figure 1:
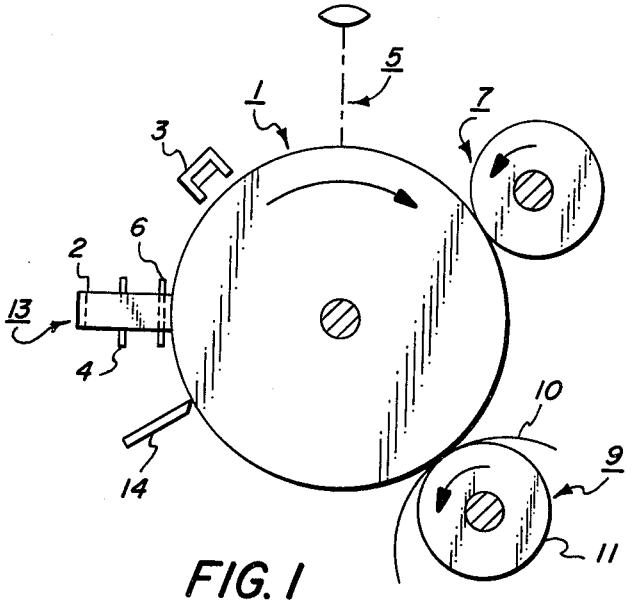
FIG. 1 shows in schematic cross-section a typical apparatus for the cyclic liquid development of charge patterns employing the means for improved re-conditioning of the reusable imaging surface.

Referring now to FIG. 1, there is shown an imaging surface generally designated 1 which in this exemplary instance may be a photoconductive selenium coated on a conductive substrate. Other photoconductive surfaces are well-known to those skilled in the art. In operation, the rotating imaging surface 1 is charged and exposed in the usual manner. A uniform charge is placed on the insulating photoconductive layer by charging means 3 which may be a corotron. The charged member is then exposed to a light image at the exposure station generally designated 5 in order to form a charge pattern. The charge pattern thus formed is then made visible at a developing station generally designated 7 using, in this example, a liquid developer in accordance with the development method described in U.S. Pat. Nos. 3,084,043 and 3,806,354.

At a typical development station 7, liquid developer is applied from a reservoir (not shown) by means of a roll (not shown) generally known as a supply roll whose lower portion dips into the liquid in the reservoir and whose upper portion is spaced by (for example) 0.25 mm from an ink applicator roll shown at development station 7 which has its surface shaped with a helical groove. The ink applicator roll (for providing a supply of ink to the imaging surface is usually provided with a flexible doctor blade (not shown) which removes liquid from the groove to below the groove upper edges due to the deformation of the blade into the groove. The developer is attracted by electrostatic attraction from the remote part of the groove to the latent image across the gap between them to develop the image. An example of this method of development is described in detail in U.S. Pat. No. 3,084,043 issued to Robert W. Gundlach, which is incorporated herein by reference, wherein there is claimed a method of development in xerography comprising positioning close but spaced from an electrostatic latnet image on an image bearing surface a substantially continuous film of electrically conductive ink comprising a homogeneous liquid solution, providing flow aiding elements in physical contact between said ink and said image bearing surface, and applying a bias to said ink whereby ink moves along said flow aiding elements and develops said electrostatic latent image.

The developed image is transferred to a receiver member 10 at a transfer station generally designated 9. At transfer station 9, receiver member 10 which may be, for example, paper entrained over roller 11 is pressed into contact with the image on imaging surface 1. The image is thus transferred to the receiver member forming the final copy. Developer material remaining on the xerographic member 1 after the transfer station 9 is removed at the cleaning station which is generally designated 13 and which is one embodiment of the present invention.

At the cleaning station 13, the imaging surface 1 is first contacted by the cleaning means 14 in order to clean the imaging surface 1 in preparation for the next cycle. In this embodiment, cleaning means 14 is a leading edge cleaning blade. In operation, the liquid developer remaining on the imaging surface 1 after the transfer station 9 is first cleaned by the cleaning blade 14 and is then contacted by liquid developer redistribution means 2 which is a cross-wiping, compressible, resilient belt, preferably a foam-backed belt, having a substantially non-absorbent working surface of raised portions and recessed portions (not shown in the drawing in FIG. 1) maintained in engagable contact with surface 1 by pressure plate or backing plate 6. The cross-wiping compressible, resilient belt or foam-backed belt is advanceable in the direction of the longitudinal axis of the imaging or other surface with which it is engaged. The belt is preferably mounted by two rotatable guide wheels (not shown) rotating on shafts 4 in such a manner that the working surface of foam belt 2 engages the entire imaging surface in the direction of the longitudinal axis of the imaging surface. As used herein, the substantially non-absorbent working surface of the foam-backed belt is that surface which contacts the imaging surface to be cleaned and which redistributes the liquid developer residues on the surface to be cleaned to other areas of the surface to be cleaned so that the residues are spread out or dissipated into a non-transferable film on the surface to be cleaned, without absorbing significant amounts of liquid developer to the extent that the absorbed liquid developer will be reapplied to cleaned surfaces. The preferred belt for this embodiment comprises a substantially non-absorbent working surface laminated to a compressible backing material, e.g., a polymer foam.

Cleaning means 14 is preferably a cleaning blade, and the surface of the cleaning blade in contact with surface 1 is preferably non-abrasive to the material of the photoconductor or interposition surface. The cleaning blade is suitably mounted (not shown) so that it engages the surface at a suitable angle. The cleaning blades in the drawings are merely illustrative, and the angles thereof can be manipulated by any person skilled in the art. The cleaning blade may assume various shapes and may assume various forms, for example, skewed, to facilitate contact with photoconductor surface 1 and removal of liquid developer therefrom.

After the point of contact of surface 1 with cleaning means 14, residual developer (not shown in FIG. 1) remains on the surface due to the inefficiency of such conventional cleaning means and due to debris retained by cleaning means 14. Liquid developer is present in quantities and patterns, for example, streaks, which interfere with the reuse of the sruface when they are at thicknesses of the surface above transfer thresholds. If developer remains on the surface in thicknesses above the transfer threshold, streaks and smudges can be carried through to subsequent cycles and printed out on subsequent copies. Streaks result from the accumulation of debris between cleaning means 14 and surface 1 so that cleaning means 14 cannot retain intimate contact evenly throughout the width of the surface, and developer remains on the surface in those areas where the cleaning means becomes separated therefrom. Foam-backed belt 2 having a working surface comprised of raised and recessed portions or comprised of multiple inefficient cleaning edges (not shown in FIG. 1), preferably a pattern of oblique parallel edges and grooves, as it advances in a direction transverse to the direction of the movement of the surface 1 which it engages, redistributes streaks and other deposits of liquid developer present on the surface being cleaned in thicknesses which are above transfer thresholds and therefore transferable during the next cyclic transfer step, to more uniformly disperse liquid developer films on the surface being cleaned in thicknesses below transfer thresholds and therefore incapable of transfer during the next cyclic transfer step.

In accordance with the instant invention, the cleaning station comprises the movable liquid developer redistributing means capable of dispersing transferable streaks, deposits, and accumulations of liquid developer remaining on a surface being cleaned, to thin films on the surface being cleaned, the thickness of the redistributed liquid developer being sufficiently thin as to be non-transferable during conventional transfer steps commonly used in liquid development processes and apparatuses.

Figure 2:
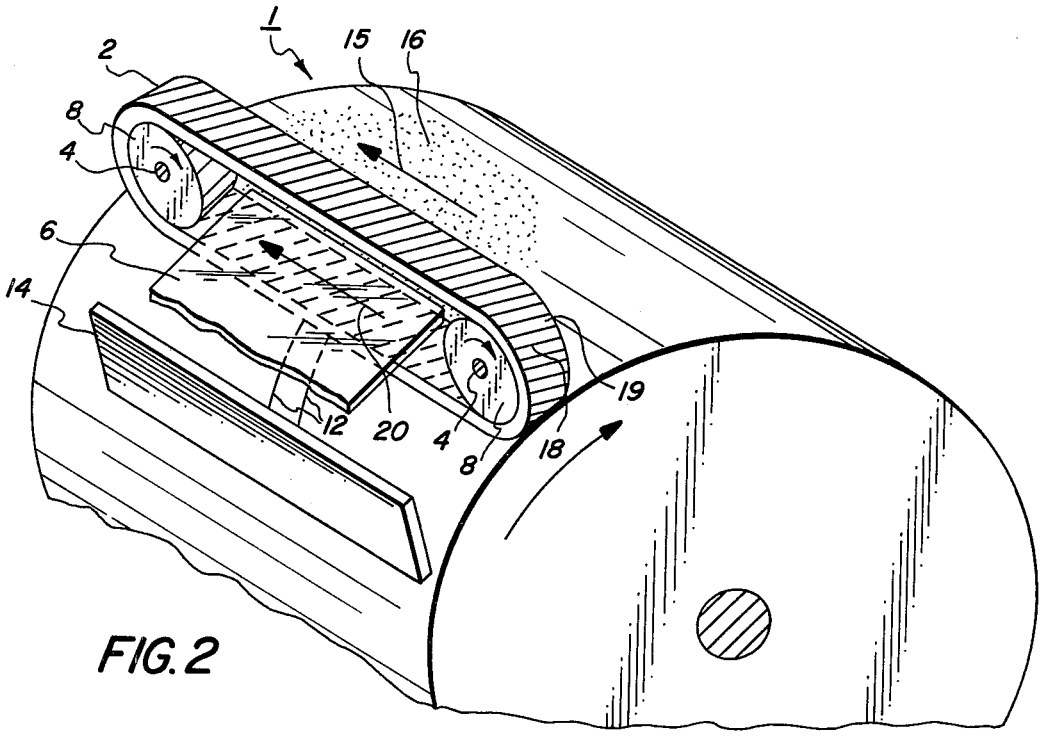
FIG. 2 is an isometric view of the liquid developer redistribution means used in conjunction with a cleaning blade.

In FIG. 2, the view of the cleaning station of this invention is shown in an isometric view to better illustrate the function of the method and apparatus for conditioning an imaging or interposition surface for a subsequent cycle after the liquid development thereon of a charge pattern and the transfer therefrom of the developed image. Foam-backed belt 2 having a working surface pattern of ridges 18 and grooves 19 spaced therebetween is loaded against the rotatable photoconductor coated drum 1 by pressure plate 6. Foam-backed belt 2 is mounted on two guide rolls 8 rotatable about a shaft 4 and positioned such that the movable belt 2 advances during operation substantially in the direction of the axis upon which the drum having the imaging surface thereon rotates. This direction is indicated by arrow 20. In the embodiment shown, the ridges 18 and grooves 19 are oriented in the direction which is substantially oblique or diagonal with the belt edge. However, it is to be understood that the pattern in the substantially non-absorbing working surface of the foam-backed belt, that is, the surface of the compressibly-backed belt which engages the surface to be cleaned, encompasses any pattern in the cleaning or wiping surface of the foam belt which will redistribute relatively thick accumulations e.g., about 10 microns or more, of liquid developer on the surface to be cleaned to relatively thin deposits of films, e.g., about 0.5 microns or less, but thinner than the thickness of the original accumulation of liquid developer, i.e., to thicknesses which are below transfer thresholds. Preferred patterns on the working surface of the compressible, resilient belt are raised ridges in parallel relationship with each other and arranged obliquely or diagonally at any angle less than or greater than 90° with the edge of the belt. Other embossed-type patterns may be used, however, to the extent that they redistribute deposits of liquid developer to non-transferable levels, e.g., irregular or regular patterns of beads, raised dots, or other geometrical designs and the like. It is these patterns on the substantially non-absorbing working surface of the belt which not only redistribute the liquid developer (rather than clean the liquid developer from the surface) to non-transferable levels on the surface being prepared or re-conditioned for a subsequent development cycle, but also substantially reduce the drag or friction between the belt and the surface being cleaned even when pressure is exerted to maintain the engagement of the working surface of the belt against the surface being cleaned or re-conditioned. A conventional cleaning blade 14 is shown, however, this may be any type of conventional cleaning means which leaves transferable deposits or accumulations on surface 1. As illustrated, streaks represented by numeral 12 remain on surface 1 after cleaning blade 14. The movement or advancement of foam-backed belt 2 having a pattern of ridges and grooves therein redistributes liquid developer streaks 12 to a non-transferable thin film of liquid developer represented by numeral 16. Arrow 15 in FIG. 2 represents the direction in which the streaks of liquid developer were redistributed to form the non-transferable thin film deposit 16.

Figure 3:
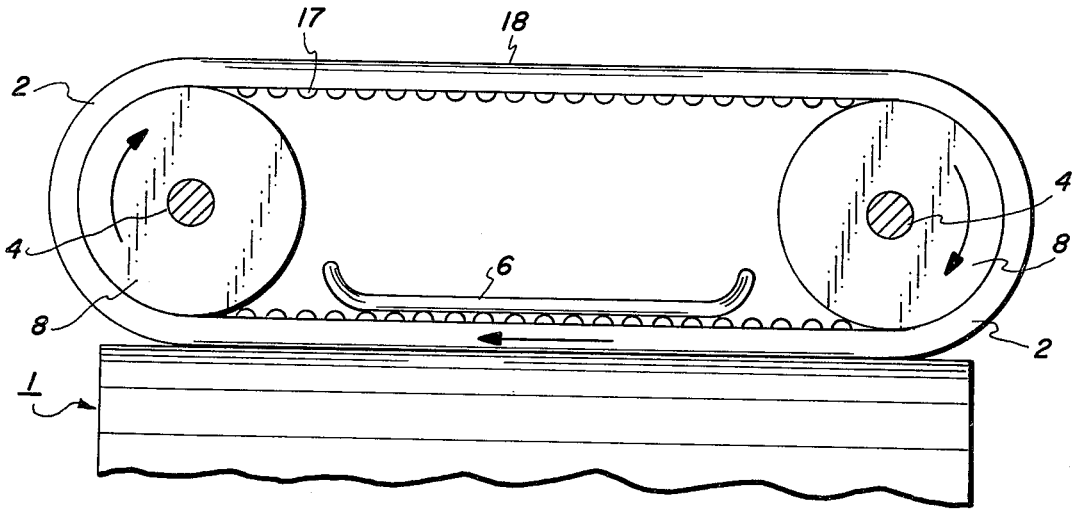
FIG. 3 is an end view of the redistribution means showing its relationship with the surface being cleaned.

FIG. 3 shows the end view of a foam-backed belt liquid developer redistribution means where numerals common with those of FIGS. 1 and 2 represent common elements. Numeral 17 represents a timing pattern, timing belt layer or timing belt to suitably seat and engage foam-backed belt 2 with guide rolls 8. Backing plate or pressure plate 6 loads belt 2 against surface 1, however, because of the pattern of raised and recessed areas on the working surface of belt 2 (no shown in FIG. 3), there is substantial reduction in drag or friction between the working surface of the belt member and the imaging or interposition surface.

As used herein, the foam backing may be any suitable compressible, resilient material. The working surface may comprise any molded or embossed, substantially non-absorbing material which will not cause significant wear to the surface being cleaned, e.g., a molded rubber or non-porous elastomer. This patterned working surface material may be laminated on a compressible backing material or it may be the backing material itself suitably modified to provide a substantially non-absorbing surface as by sealing off the pores.

Figure 4:
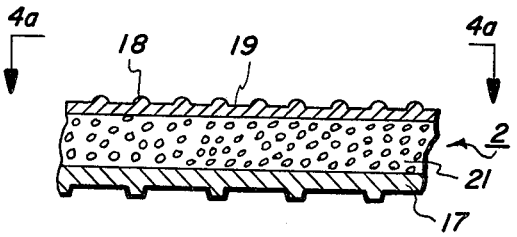
FIG. 4 is an cross-sectional view of a section of a foam belt of the present invention showing a preferred pattern of parallel edge on the working surface.

In FIG. 4 there is illustrated a preferred belt construction for compressible, resilient belt or foam-backed belt 2 wherein the belt comprises raised areas or ridges represented by numeral 18 and depressed or recessed areas designated by numeral 19 represents the working surface of belt 2. The main body of the belt represented by numeral 21 is a suitable foamed rubber or other elastomer or polymer, e.g., polyurethane foam, of sufficient strength to withstand the pressure applied by the rigid pressure plate; the tension applied to it by engaging it with the two guide rollers; and the flexing and bending it encounters by conforming to the circumference of the guide rollers. Preferred foam materials are foam open-cell polyurethane, foamed silicone elastomers and other foamed elastomeric materials which are chemically resistant to the composition of the liquid developer being redistributed. Suitable elastomeric foamed resilient materials capable of bearing a patterned working surface whether glued or laminated thereon or whether formed within the compressible, resilient or foam belt material itself, are commercially available, and such materials can be chosen by one skilled in the art for use in the process and apparatus of the present invention. The foam-backed belt of FIG. 4 is glued to a timing belt of suitable material, e.g., natural or synthetic rubber, appropriately patterned to engage guide rolls. Typical working surfaces are preferably about 1 cm to about 5 cm wide. Typical compressible, resilient belt materials compress by 10 percent or more when pressure is applied thereto and preferred compressible resilient material compresses up to 50 percent or more.

Figure 4A:
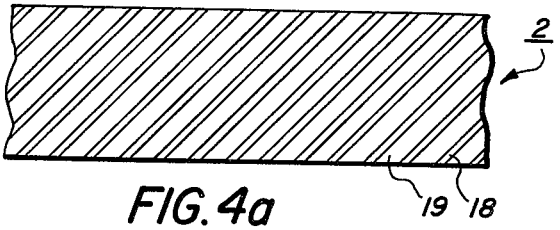
FIG. 4*a* is a view of a preferred pattern of parallel edges on the working surface of the redistribution belt as seen from the perspective (top view) indicated in FIG. 4.

FIG. 4*a* represents a most preferred working surface wherein parallel ridges 18 (lands) and grooves 19 (valleys) are diagonally formed in the working surface material at an angle of about 45° from the longitudinal direction of the belt. The oblique pattern of grooves and ridges is a most preferred embodiment for redistribution of the liquid developer because this pattern more readily deposits, transfers or redistributes a film of the liquid developer on the surface being cleaned whereas other patterned working surfaces tend to accumulate and deposit minor amounts of the redistributed liquid developer at the edge of the surface being cleaned.

Figure 5:
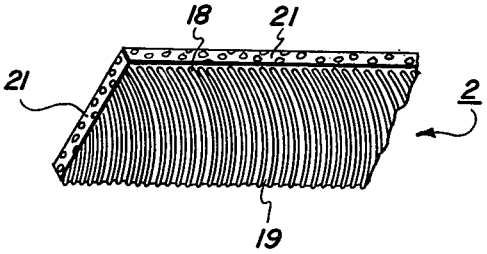
FIG. 5 is a isometric view of a section of preferred redistribution belt or web showing a preferred pattern of parallel edges on the working surface of the belt or web.

FIG. 5 shows an isometric view of a preferred working surface having parallel ridges 18 and grooves 19 on foam-backed belt material 21. The timing belt is not shown in this illustration.

Means for rotating guide rolls 8 and imaging surface 1 are not specifically shown, but it is within the purview of one skilled in the art to provide means for moving or advancing these members. at suitable speeds. Means may also be provided for engaging and disengaging the movable liquid developer redistribution means from the surface being cleaned, as desired.

The pressure or force exerted by the cleaning elements 2 and 14 upon the surfaces being cleaned need only be sufficient to clean the surface so that it can be reused, and such force must not exceed the limits which will substantially reduce the life or cause excessive wear of the surfaces of the elements of the cleaning station. It is for this reason that the elements should not be made of materials which cause abrasive action upon the surfaces which they contact. One skilled in the art can determine the adjustments required without resorting to undue experimentation.

It is within the scope of this invention to incorporate multiple cleaning blade members and/or multiple patterned foam-backed belts in the cleaning station as long as the designated elements are critically positioned in the apparatus in such a manner that at least one movable patterned belt for redistribution of transferable quantities of liquid developer contacts the surface to be cleaned at a point following the contact of the surface with a conventional cleaning member. Thus, there must be at least one conventional cleaning member element contacting the surface to be cleaned, followed by at least one movable patterned belt contacting the same surface to practice the invention. The patterned belts may also engage the surface to be cleaned in a slightly skewed arrangement. Other elements, such as, collecting troughs for liquid developer, control mechanisms and the like, not shown in the drawings or described herein, can be incorporated within the scope of the invention as long as such elements do not interfere with the critical location and function of the conventional cleaning means and the movable patterned belt elements.

In accordance with the stated objects, the present invention provides a suitable apparatus and method for preventing transfer of residual amounts of liquid developer from reusable photoconductor and interposition surfaces when transferable amounts of liquid developer remain after cleaning with conventional cleaning elements. By this invention excessive cleaning requirements, generally constituting substitution of wiper blades, brushes and other devices, have been eliminated.

While this invention has been described with reference to the structures and process steps disclosed herein, it is not confined to the details set forth; and this application is intended to cover such modifications or changes as may come within the purposes of the improvements or the scope of the following claims.

What is claimed is:

1. A method for improved conditioning of reusable imaging surfaces after the liquid development thereon of a charge pattern and the transfer therefrom of the developed image, said method comprising:

(a) bringing the imaging surface into moving contact with a cleaning means; and thereafter (b) bringing the imaging surface into substantially transverse moving contact with a moving compressible, resilient belt having a pattern of raised and depressed portions on the substantially non-absorbing, non-porous, solid working surface for redistributing irregular deposits of liquid developer remaining on the imaging surface after cleaning to those areas of the imaging surface bearing lesser or no residual liquid developer, the redistributed liquid developer being present on the imaging surface in thicknesses which are non-transferable.

2. The method of claim 1 wherein the compressible, resilient belt comprises a substantially non-absorbing working surface laminated to a compressible foam backing material.

3. The method of claim 2 wherein the resilient belt is laminated to a timing belt.

4. The method of claim 2 wherein the compressible, resilient belt is a polyurethane foam having thereon a substantially non-absorbent, non-porous, solid working surface with oblique parallel ridges engaging a moving cylindrical imaging surface.

5. The method of claim 4 wherein the working surface has a surface pattern of parallel grooves and ridges which are about 45° from normal (relative to the direction of motion of the imaging surface).

6. The method of claim 1 wherein the raised and depressed portions are parallel ridges and grooves which are arranged at angles less than or greater than 90° from normal (relative to the direction of motion of the surface to be cleaned).

7. The method of claim 1 comprising moving the compressible, resilient belt in a direction transverse to the direction of movement of the surface to be cleaned.

8. An apparatus for the improved conditioning of reusable surfaces to be cleaned after the liquid development thereon of a charge pattern and the transfer therefrom of the developed pattern comprising:

(a) a cleaning means which is brought into moving contact with the surfaces to be cleaned; and downstream therefrom in the direction of motion of the surface to be cleaned;

(b) a movable, compressible resilient belt having a pattern of raised and depressed portions on the substantially non-absorbing, non-porous, solid working surface for redistributing transferable deposits of liquid developer remaining on the surface to be cleaned to other areas of said surface, the resilient belt being movable in a direction substantially transverse to the direction of movement of the surface to be cleaned, whereby the liquid developer is non-transferable after redistribution.

9. The apparatus of claim 8 wherein the compressible resilient belt comprises a substantially non-absorbing working surface laminated to a compressible foam backing material.

10. The apparatus of claim 9 wherein the resilient belt is laminated to a timing belt.

11. The apparatus of claim 10 wherein the compressible, resilient belt is a polyurethane foam having thereon a substantially non-absorbent, non-porous, solid working surface with oblique ridges being held against a moving cylindrical imaging surface.

12. The apparatus of claim 11 wherein the working surface has a surface pattern of parallel grooves and ridges which are about 45° from normal (relative to the direction of motion of the imaging surface).

13. The apparatus of claim 8 wherein the raised and depressed portions are parallel ridges and grooves which are arranged at angles less than or greater than 90° from normal (relative to the direction of motion of the imaging surface).

14. The apparatus of claim 8 wherein the compressible, resilient belt is movable in a direction transverse to the direction of movement of the surface to be cleaned.

15. The apparatus of claim 8 wherein the belt means is skewed.

16. The apparatus of claim 8 wherein the belt means is movable in a direction which is perpendicular to the direction of movement of the surface to be cleaned.

17. The apparatus of claim 8 wherein the cleaning means is a resilient elastomeric blade.

18. Electrostatographic reproduction method comprising forming a latent electrostatic image on a moving imaging surface, developing the latent image with liquid developer, transferring the developed image to a support material and cleaning the liquid developer remaining on the imaging surface by bringing the imaging surface into moving contact with a cleaning means for removing liquid developer remaining on the imaging surface and thereafter bringing the imaging surface into moving contact with a moving redistribution means movable in a direction substantially transverse to the direction of movement of the imaging surface, said redistribution means being a compressible, resilient belt having a substantially non-absorbing, non-porous, solid working surface for depositing transferable residues remaining on the imaging surface after cleaning to other areas of the imaging surface in thicknesses which are non-transferable.

19. Electrostatographic reproduction apparatus comprising a movable imaging surface, means for forming a latent electrostatic image on said surface, means for applying liquid developer to said latent image to develop the image, means to transfer the developed image to a sheet of support-material and improved cleaning means to clean liquid developer remaining on the imaging surface after transfer comprising a cleaning blade for removing substantial quantities of liquid developer remaining on the imaging surface after transfer and movable, resilient belt means having a pattern of raised and depressed portions on the substantially non-absorbing, non-porous, solid working surface for redistributing irregular deposits of liquid developer in contact with the imaging surface to redistribute transferable quantities of liquid developer to other areas of the imaging surface in thicknesses which are non-transferable, and a drive mechanism to move said resilient belt means in a direction transverse to the direction of movement of the imaging surface.

* * * * *